United States Patent [19]

Sulenski

[11] Patent Number: 4,943,830

[45] Date of Patent: Jul. 24, 1990

[54] DEVELOPER DISPENSING APPARATUS WITH A SPRING ELEMENT HOLD DOWN SHOE MECHANISM

[75] Inventor: Timothy J. Sulenski, Webster, N.Y.

[73] Assignee: Xerox Corporation, Stamford, Conn.

[21] Appl. No.: 320,183

[22] Filed: Mar. 7, 1989

[51] Int. Cl.[5] ..... G03G 15/06

[52] U.S. Cl. ..... 355/245; 222/410; 222/413; 222/DIG. 1

[58] Field of Search ..... 222/240, 241, 412, 413; 222/DIG. 1, 228, 410; 355/253, 260, 245, 299; 118/653, 657

[56] References Cited

U.S. PATENT DOCUMENTS

| | | | |
|---|---|---|---|
| 3,724,725 | 4/1973 | Stauffer | 222/240 |
| 3,799,404 | 3/1974 | Taupin | 222/413 |
| 4,659,212 | 4/1987 | Ichihara et al. | 355/299 X |
| 4,739,907 | 4/1988 | Gallant | 222/240 |

*Primary Examiner*—Arthur T. Grimley
*Assistant Examiner*—Willima J. Royer

[57] ABSTRACT

A developer dispensing apparatus includes a coiled spring auger which is rotated through a developer bed in a direction to dispense developer through a dispensing opening. The spring auger has an unsupported free end which is non-fixedly placed over a hold down mechanism attached to one end of the developer housing and which projects inwardly into the toner bed. As the spring auger rotates a tendency of the free end to vertically rise from the developer is inhibited by making contact with the hold down mechanism. By proper configuration of the contacting surface of the hold down mechanism, a thumping or antibridging action is imparted to the toner by periodically causing the coiled end to wind and unwind storing and releasing energy along the developer bed length.

3 Claims, 4 Drawing Sheets

DEVELOPER DISPENSING APPARATUS WITH A SPRING ELEMENT HOLD DOWN SHOE MECHANISM

BACKGROUND AND INFORMATION DISCLOSURE STATEMENT

The present invention relates to a developer dispensing apparatus for a developer station in a xerographic printing machine and, more particularly, to an apparatus which utilizes a helical spring as an auger mechanism. In prior art printing machines, the toner material used to develop a latent image formed on a photoreceptor surface is consumed in a development process and must be periodically replaced within the development system in order to sustain continuous operation of the machine. One technique which has become generally accepted is the use of a separate toner or developer hopper with a dispensing mechanism for adding the toner from the hopper to the developer apparatus on a regular, or as needed, basis. In addition, it has become common practice to provide replenishing toner supplies in a sealed container which, when placed in the automatic printing machine, can be automatically opened to dispense toner. In such systems a difficulty may arise in uniformly dispensing the developer since, in a large mass of toner particles, which frequently is somewhat tacky, the particles may tend to agglomerate, become compacted and form a bridging structure in the toner container.

Various devices have been used to overcome the above-noted problems. For example, in the xerox 1025 Copier, the toner hopper is provided with a coiled spring auger which moves the toner material from one end of the hopper to the other. In this type of system, the auger is driven about one end and unsupported at the other end. Difficulties may be experienced in two areas. Depending upon the developer composition, the free end of the coiled spring auger may ride upward through the developer bed. By failing to stay completely submerged within the developer bed, the transport efficiency is reduced. In addition, for a system in which a toner bottle has an auger to transport toner therein which is driven and supported about one end and intended to dispense toner through a dispensing opening at the other end, as the auger is rotatably driven tending to drive toner toward the dispensing end the amount of toner at the dispensing end increases and tends to become compacted forming a bridge which tends to provide a force on the spring auger compressing it in a direction toward the driven end. If this force becomes too great, it may force the auger spring end past the dispensing opening in the toner cartridge thereby removing the antibridging function of the auger at the dispensing opening resulting in bridging over the dispensing opening and a lack of flow of toner out of the toner cartridge.

Anti-bridging devices utilizing wire spring augers are known in the art. For example, U.S. Pat. No. 4,739,907 issued on April 26, 1988 and assigned to the same assignee as the present invention, and U.S. Pat. No. 3,724,725 issued April 3, 1973 and assigned to IBM, disclose two spring members located within a toner dispenser which are rotated past each other in opposing directions. However, these disclosures do not consider the problem of unwanted movement of the spring auger at the free end.

The present invention is therefore directed to a developer dispensing apparatus which utilizes a helical spring auger to dispense toner within a toner housing. Means are provided to interact with the free end of the spring to both restrain an upward motion of the free end of the spring as well as to impart an anti-bridging effect to the toner transport. More particularly, the invention is directed towards a developer dispensing appartus including an elongated container enclosed at both ends having a substantially circular cross section capable of containing a given quantity of developer, said container having a dispensing opening adjacent one end and containing an integral developer transport mixing member rotatably supported at the opposite end of said container and unsupported at said one end, said mixing member comprising a coiled spring element adapted to rotate in a direction so as to transport developer along its length toward said dispensing opening, said dispensing apparatus characterized by a mixing member hold down element fixedly attached to the container end associated with the unsupported end of said spring element, at least a portion of said spring element rotatably encircling said hold down element, whereby any vertical movement of the unsupported end of said mixing member during rotation is restrained by the mechanical contact with the adjacent surface of said hold down element.

DESCRIPTION OF THE INVENTION

Figure 1:
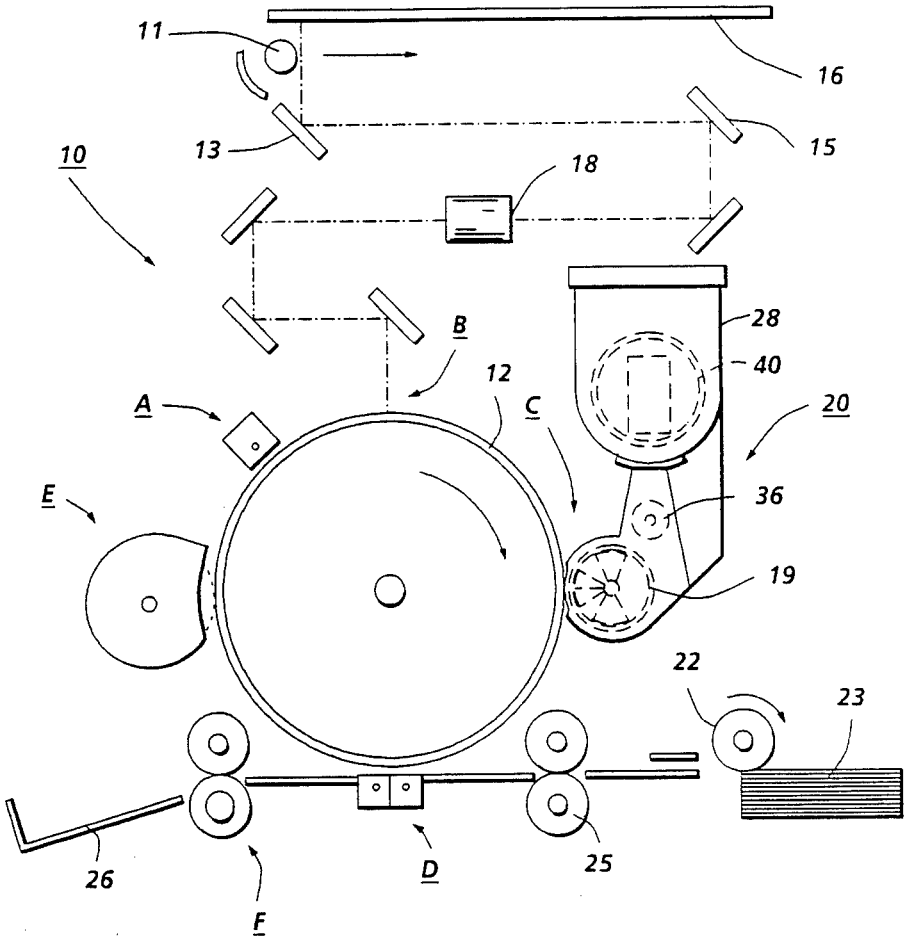
FIG. 1 is a schematic side view representation of an automatic printing machine which uses the developer dispensing apparatus according to the present invention.

Referring now to FIG. 1, there is shown an automatic xerographic printing machine 10 including a developer assembly which has a developer storage and dispensing cartridge, according to the present invention. As used herein the term developer is intended to define all mixtures of toner and carrier as well as toner or carrier alone. The printer includes a photosensitive drum 12 which is rotated in the direction indicated by the arrow to pass sequentially through a series of xerographic processing stations; a charging station A, an imaging station B, a developer station C, a transfer station D, cleaning station E and fusing station F.

A document to be reproduced is placed on platen 16 and scanned by moving an optical system including a lamp 11 and mirrors 13 and 15. The reflected image is projected through stationary lens 18 to produce a flowing light image on the drum surface which has been charged at charging station A. The image is then developed at development station C to form a visible toner image. The development station C includes a developer roll 19 which may, for example, provide a magnetic brush of developer to the drum 12. Roll 19 is supplied with developer from the developer and dispensing apparatus 20. Copy sheet 23 is fed from a supply of cut sheets by feed roll 22 to registration rolls 25, in synchronous relationship with movement of the image on the drum surface. Following transfer of the toner image to the copy sheet, the copy sheet is stripped from the drum surface and directed to the fusing station F to fuse the toner image on the copy sheet after which the drum surface advances to cleaning station E where residual toner remaining on the drum surface is removed prior to the drum surface again being charged at charging station A. Upon leaving the fuser, the copy sheet with the fixed toner image thereon is transported to sheet collecting tray 26.

Figure 2:
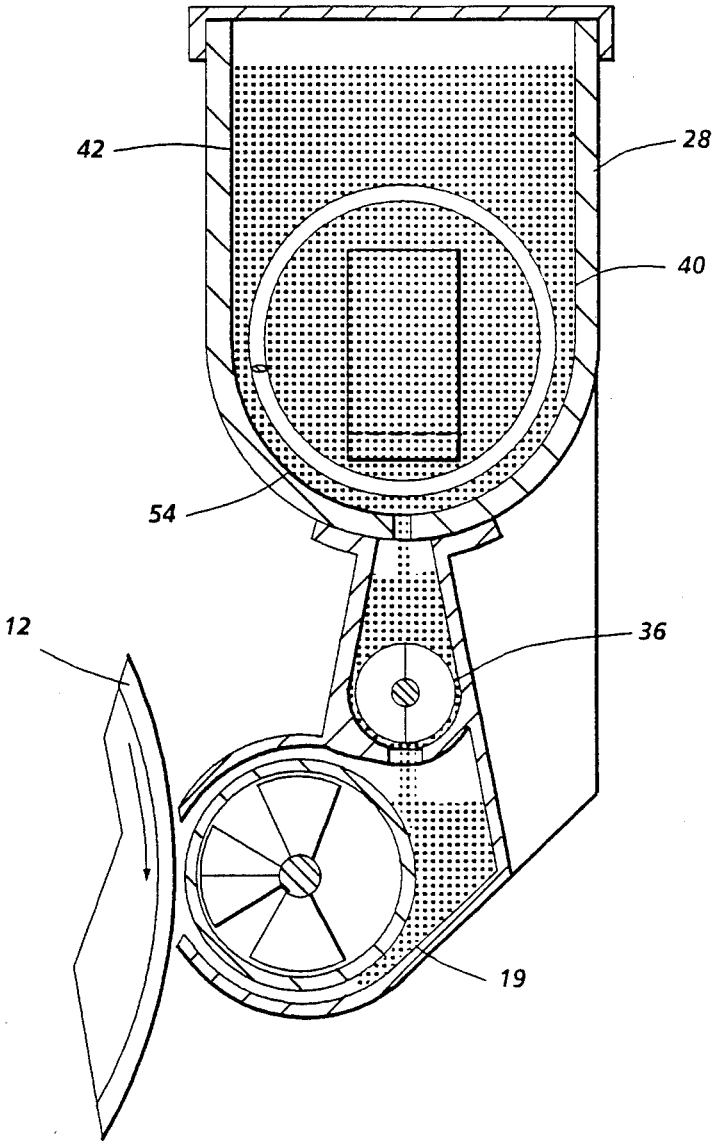
FIG. 2 is a schematic cross-sectional view of the developer unit shown in FIG. 1 containing the developer and dispensing apparatus of the present invention.
Figure 3:
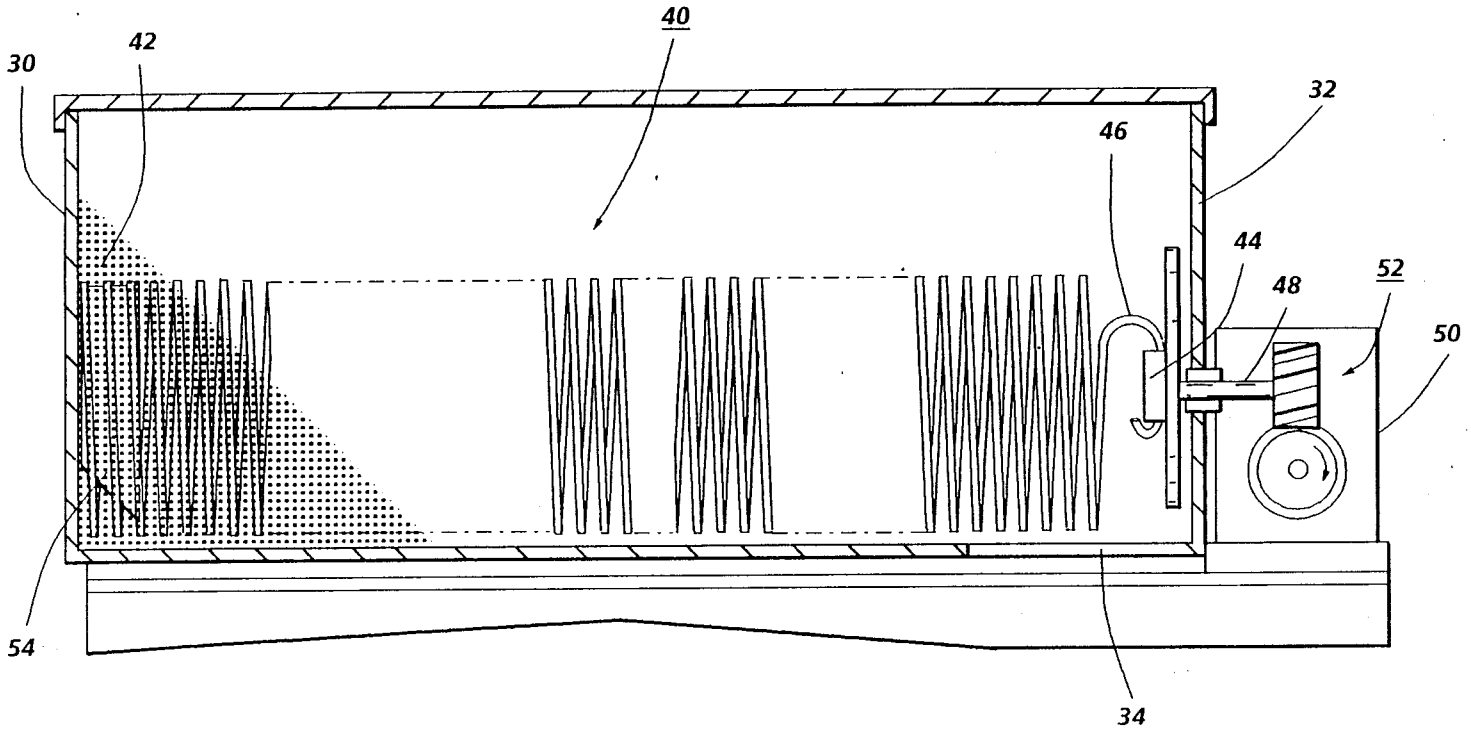
FIG. 3 is a side view partly cut away of the developer storage housing illustrating the location of the rotating spring auger system of the present invention.
Figure 4:
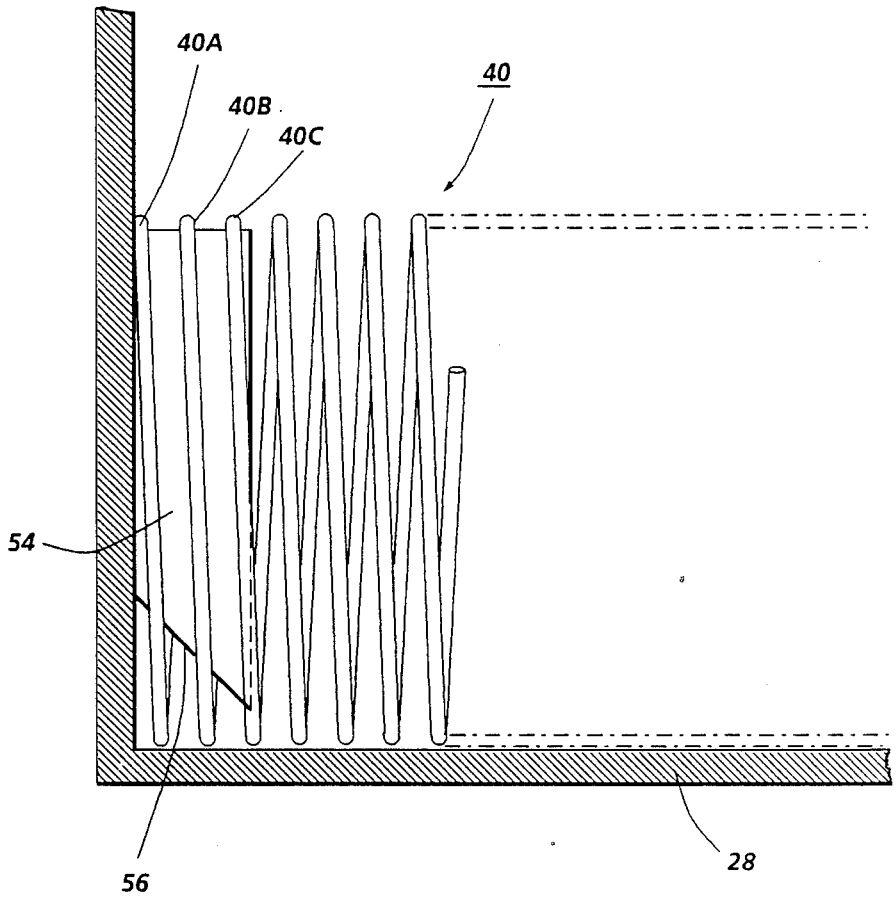
FIG. 4 shows an enlarged view of the hold down mechanism which constrains the motion of the auger system at its free end.

The developer storage and dispensing apparatus of the present invention will be described with further reference to FIGS. 2 through 4. Developer dispensing apparatus 20 includes a generally cylindrical elongated container 28 enclosed at both ends by end plates 30 and 32. At the bottom of the cylindrical container is a dispensing opening 34. Developer is dispensed from the dispensing opening 34 from one end of the container 28 with the developer falling by gravity into auger assembly 36 which delivers the developer to the developer sump associated with the developer roll 19.

The developer is moved towards opening 34 by means of a helical spring auger system 40 which extends along the length of the container between end plates 30, 32 and which is submerged within the toner bed 42. In a typical construction the diameter of the auger is about 39 mm with a pitch of about 5.5 mm, pitch being defined as a distance between adjacent springs in the coil. Spring auger 40 is attached to shaft 44 by a hook coil 46 which is mounted in the hole through worm gear shaft 48. Shaft 44 is rotated slowly by motor 50 via a worm and worm gear assembly 52. Fixedly attached to end plate 30, according to the main feature of the present invention, is a hold down shoe mechanism 54 shown in end view in FIG. 2, and in enlarged view in FIG. 4. The shoe has a rectangular wedged configuration presenting a beveled surface 56 extending downwardly from the rear wall at approximately a 45° angle. The end of spring auger 40 has several coils 40A, 40B, 40C which loosely encircle shoe 54. In operation, spring auger 40 is rotated by motor 50 via worm gear assembly 52 in the dispensing direction so that developer is moved towards dispensing opening 34. Depending upon the composition of the developer bed and particularly when the developer bed comprises a mixture of toner and carrier, the "free" end of the auger has a tendency to move vertically upward through the developer mixture. If this upward movement is not corrected the auger would rise to the top of the developer bed greatly reducing the efficiency of the transport. However, referring to FIG. 4, and according to the present invention, if the auger begins an upward excursion, coils 40A, 40B, 40C encounter the beveled surface 56 of shoe 54. The auger continues to rotate but is now prevented from rising any further vertically through the developer bed. The auger's rotation is slightly affected by the mechanical interference with surface 56 but in a beneficial fashion. As the auger rotates, the auger end begins wind up to a fraction of a rotation depending upon a number of coils constrained by shoe 54. As the coils wind up energy is stored. At some point, (approximately ¼ rotation for the embodiment shown), the resistance to rotation is overcome the coils "slip" back to their normal rotational position thereby releasing the stored energy as it uncoils. The release of this energy is transferred to the developer material surrounding the auger and, in effect, provides a thumping action which serves an anti-bridging function. The storage and release of energy provided by the interaction of spring auger 40 and hold down shoe 54 has a predictable frequency which is constant irrespective of the amount of developer through which the auger is rotating. The amplitude of the energy released at uncoiling is directly proportional to the number of coils that are encircling shoe 54.

While the hold down shoe 54 and the preferred embodiment has a beveled edge 56, other configurations are possible consistent with the interaction principle described above. Edge 56 may be beveled at a different angle or have a semi-circular configuration while still retaining the energy storing and anti-bridging function. The surface can also be perpendicular to the back wall in which case it would be useful only for the function of restraining the upward movement of the auger. The invention is intended to embrace all such alternatives and modifications as may fall within the scope and spirit of the appended claims.

What is claimed is:

1. A developer dispensing apparatus including an elongated container enclosed at both ends having a substantially circular cross section capable of containing a given quantity of developer, said container having a dispensing opening adjacent one end and containing an integral developer transport mixing member rotatably supported at the opposite end of said container and unsupported at said one end, said mixing member comprising a coiled spring element adapted to rotate in a direction so as to transport developer along its length toward said dispensing opening, said dispensing apparatus characterized by further including a hold down shoe mechanism fixedly attached to the container end associated with the unsupported end of said spring element, at least a portion of said spring element rotatably encircling said hold down mechanism whereby any vertical movement of the unsupported end of said mixing member during rotation is restrained by the mechanical contact with the adjacent surface of said hold down mechanism.

2. The developer apparatus of claim 1 wherein said surface adjacent to said hold down shoe mechanism has a beveled configuration extending downwardly from a fixed location on the end wall whereby the spring element encounters a resistance to rotation by said beveled edge and periodically stores and releases energy during a portion of a rotational cycle, said energy release thereby providing an anti-bridging impulse to the developer.

3. The developer apparatus of claim 2 wherein said adjacent surface of said hold down shoe mechanism has a curved configuration.

* * * * *